United States Patent [19]

Phares

[11] 4,351,311

[45] Sep. 28, 1982

[54] PULLED BOW ARROW HOLDER

[76] Inventor: Gary L. Phares, 118 Chestnut St., Elkins, W. Va. 26241

[21] Appl. No.: 283,935

[22] Filed: Jul. 16, 1981

[51] Int. Cl.[3] ..... F41B 5/00

[52] U.S. Cl. ..... 124/41 A

[58] Field of Search ..... 124/41 A, 24 R, 88, 124/35 A

[56] References Cited

U.S. PATENT DOCUMENTS

| | | | |
|---|---|---|---|
| 1,847,593 | 3/1932 | Cameron | 124/24 R |
| 2,665,679 | 1/1954 | Gaskell | 114/24 R |
| 2,975,780 | 3/1961 | Fisher | 124/41 A X |
| 3,406,675 | 10/1968 | Fredrickson | 124/41 A X |
| 3,504,659 | 4/1970 | Babington | 124/41 A X |
| 3,890,951 | 6/1975 | Jennings et al. | 124/41 A |
| 4,071,014 | 1/1978 | Trotter | 124/41 A |
| 4,282,850 | 8/1981 | Warnicke | 124/41 A X |
| 4,287,868 | 9/1981 | Schiff | 124/41 A |

*Primary Examiner*—Richard C. Pinkham
*Assistant Examiner*—William R. Browne
*Attorney, Agent, or Firm*—Arnold G. Gulko

[57] ABSTRACT

Apparatus is disclosed for holding an arrow in a pulled bow and which releases the arrow when the bow is pulled slightly beyond the position in which the arrow is held. This is accomplished by a support attached to the bow which carries a movable arrow-holding bar having a point-receiving indentation. This bar is movably mounted to shift from an arrow-holding position in front of the point of the arrow in the pulled bow to a second position out of the path of the arrow. Trigger members are carried by the support immediately forward of the bow to move the bar into the path of the arrow, and a spring device is provided to bias the bar out of the path of the arrow so that the arrow will be freed of the obstruction provided by the bar when the point of the arrow is pulled out of the indentation. When the bar is positioned to the rear of the bar, and when an arrow guide is positioned at the rear of the support, short arrows which do not reach the bow when the string is fully pulled can be used.

9 Claims, 4 Drawing Figures

Fig. 1
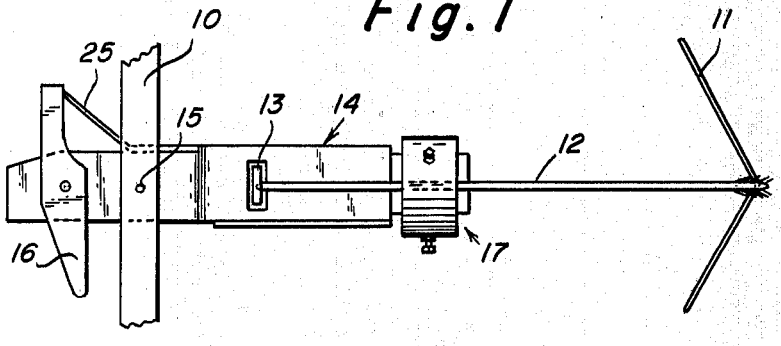
Fig. 2
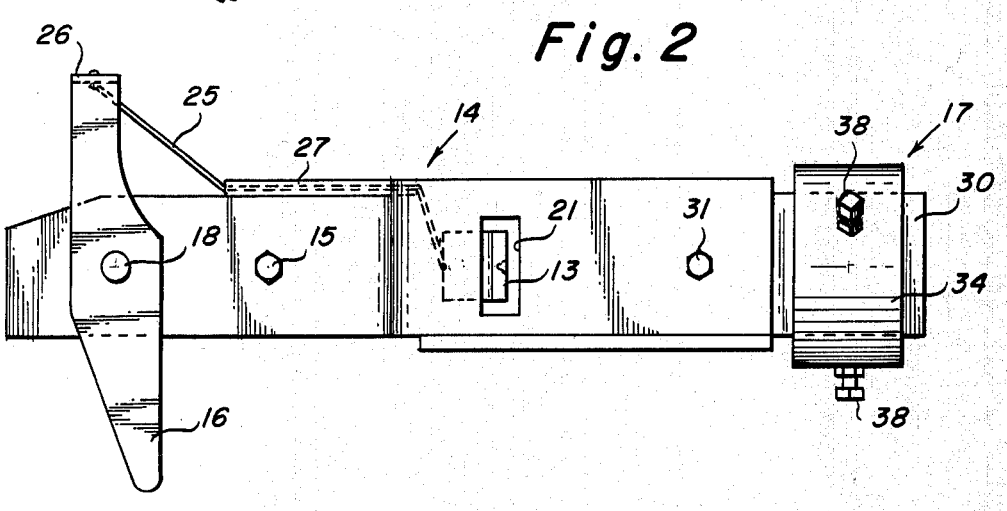
Fig. 3
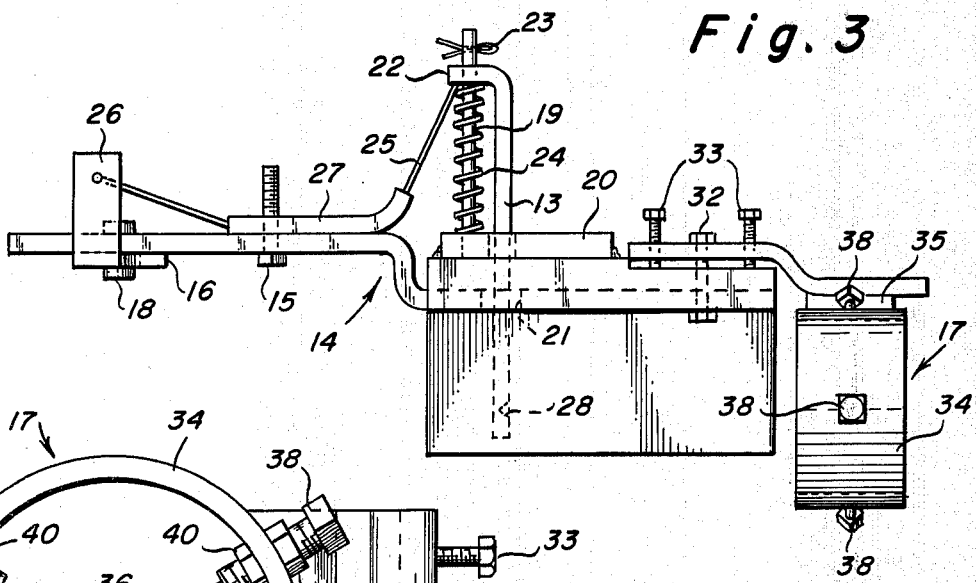
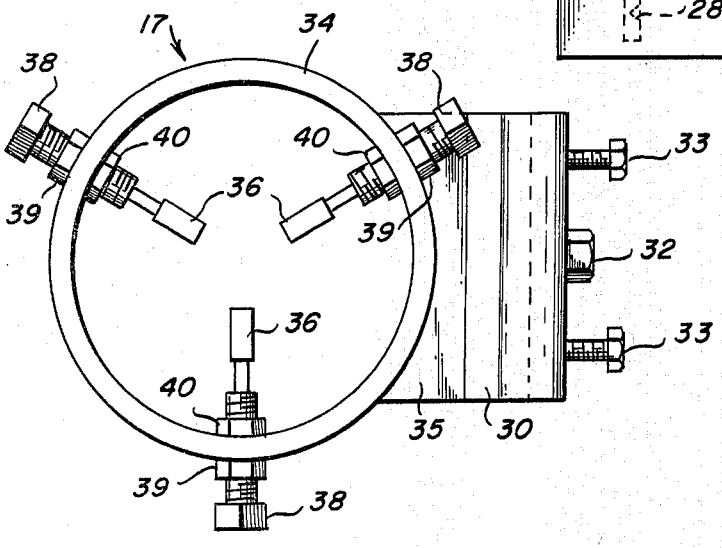
Fig. 4

PULLED BOW ARROW HOLDER

DESCRIPTION

Technical Field

This invention relates to archery, and more particularly to apparatus for holding an arrow in a pulled bow to be released whenever desired. This speeds the process of releasing an arrow. With the arrow held in a pulled bow, per this invention, it becomes possible to employ short arrows in a large bow while pulling the bow to its fully pulled position in which the short arrows do not reach the bow, and this is a feature of this invention.

Background Art

Two aspects of archery are old and well known. First, it takes considerable strength to pull a bow, so one cannot move around with the arrow in a position for instant release. As a result, when one wishes to shoot an arrow, one must position the arrow and aim and pull the bow before an arrow can be released. This is slow and laborious. Second, arrows come in various sizes, and it is not presently feasible to shoot short arrows from a large bow. These well known disadvantages of normal archery practice are countered by this invention.

Disclosure of Invention

In accordance with this invention, apparatus is provided for holding an arrow in a pulled bow in such manner that the arrow can be released when the bow is pulled slightly beyond the position in which the arrow is held. This is accomplished by attaching a support to the bow where the same is gripped by the archer, and by movably mounting on the support an arrow-holding bar having an arrow point-receiving indentation. The bar is mounted to move from an arrow-holding position in front of the point of the arrow in the pulled bow to a second position out of the path of the arrow. Trigger means are carried by the support immediately forward of the bow so that the archer can operate the trigger to move the bar into the path of the arrow, and means are provided to bias the bar out of the path of the arrow so that the arrow will be freed of the obstruction provided by the bar when the point of the arrow is pulled out of the arrow point-receiving indentation.

In preferred construction, the support extends rearwardly from the bow, and the arrow-holding bar extends at a right angle to the support in front of the point of the arrow when the bar is in its arrow-holding position. It is preferred to mount the bar for longitudinal sliding movement along its length, and spring means are provided to bias the bar away from its arrow-holding position. This is normally done by mounting the arrow-holding bar for sliding movement through a slot in the support. In such a construction, the trigger is connected to a cable for moving the arrow-holding bar against the pressure of the spring into arrow-holding position.

It is a feature of this invention to mount an arrow guide on the rear of the support to slidingly engage the shaft of an arrow between the pulled string and the bow. With such arrow guide, and when the arrow-holding bar is positioned rearwardly of the bow, arrows too short to reach the bow when the string is fully pulled may be projected from the bow. The means to slidingly engage the shaft of an arrow preferably comprises a circular holder which carries three circumferentially spaced longitudinally adjustable prongs for defining an arrow shaft guidway. Particularly when short arrows are to be employed, the support carries a security plate positioned beneath the arrow-holding bar to extend beneath the held arrow. This security plate overlies the forearm of the archer when the bow is pulled, and this prevents misdirected arrows from striking the forearm.

To consider features of preferred construction in greater detail, the support is attached to the bow at the far side thereof (remote from the bow-grasping arm) and it extends along the length of the held arrow. The arrow-holding bar is desirably mounted on the far side of the support to slide through a slot in the support, and a compressed spring is used to hold the bar out of the arrow's path. The trigger is mounted on the support in front of the bow, and the bar is mounted to the rear of the bow and the arrow guide is mounted even more rearwardly. In this way the arrow is pulled until the arrow head is to the rear of the retracted bar and the arrow shaft is held in the guide. The archer's forefinger on the hand grasping the bow is free to operate the trigger and this moves and holds the bar in front of the arrow's head. The pull on the bow is now eased to move the point of the arrow into the indentation in the bar, and situation is now fixed. The archer can hold the bow with one hand and he can hold or release the string as he wishes, for the arrow is now jammed between the bar and the pulled string.

With the arrow held, the archer can aim the bow, and then, when he wishes, he need only slightly pull the sting to draw the arrow point out of the indentation in the bar. When this is done, the bar moves out of way, and release of the string will shoot the arrow.

With the bar mounted to the rear of the bow, short arrows can be fired, but if it is mounted in front of the bow, arrows of normal length can be accomodated.

While sliding movement of the bar is preferred, especially since it allows a security plate to be used without interfering with the desired bar movement, other movements and mountings are practical, including a simple pivotal mounting with gravity dropping the bar out of the arrow's path.

The invention will be more fully described in connection with the accompanying drawings in which:

FIG. 1 is a partial side elevation showing an arrow held between a pulled string and an arrow-holding bar mounted to the rear of the bow;

FIG. 2 is a side elevation showing the structure which is attacted to the bow to provide the combination illustrated in FIG. 1;

FIG. 3 is a plan view of the structure shown in FIG. 1; and

FIG. 4 is a side elevation of an arrow guide constructed in accordance with this invention.

Referring more particularly to FIG. 1, it will be seen that a bow 10 is shown with its string 11 in a fully pulled position in which an arrow 12 is drawn back so that the point of the arrow 13 is jammed against a bar 13 mounted on a support 14. The support 14 extends along the length of the arrow 12 and is attached to the bow 10 by bolts 15. Support 14 extends forwardly of bow 10 where it holds trigger 16 and it also extends rearwardly of the bow where it supports bar 13. Also, and especially where the bar 13 is carried to the rear of the bow 10, an arrow guide 17 is mounted at the rear of the support 14.

The structure which is attached to the bow is shown on an enlarged scale in FIGS. 2 and 3 from which it will be seen that the support 14 is constituted by a steel bracket which extends in both directions from the bolt 15 which is employed, as noted in FIG. 1, to secure the support to the bow. At the forward end of the support 14 is a trigger 16 which is pivotably mounted to the support by pivot 18. To the rear of bolt 15 is a rod 19 which is mounted on a block 20 which is welded to the support to strengthen the same. The bar 13 extends through a slot 21 in the support 14 and block 20 and the end 22 of the bar 13 is bent over and drilled to slide on the rod 19. A cotter pin 23 is used at the end of rod 19 to prevent the bar 13 from being pushed off the rod.

It will be particularly seen that a compression spring 24 surrounds the rod 19 to bias the bar 13 into a retracted position in which it is out of the path of the arrow 12. When the trigger 16 is manipulated by the archer, it pulls cable 25 which is secured at one end to a flange 26 at the upper end of trigger 16, and the cable extends through tube 27 and is secured at its other end to the end 22 of the bar 13. When trigger 16 is operated, it pivots to pull cable 25 and this slides bar 13 through slot 21 against the pressure of spring 24 so that the forward end of bar 13 extends across the path of arrow 12. Bar 13 is formed to include an arrow point-receiving indentation 28 and the point of the arrow enters this indentation to jam the arrow between the bar 13 and the string 11.

The arrow guide 17 is adjustably attached to the rear of the support 14, and this is done by means of extension support 30 which is attached by means of bolt 31 and nut 32, adjustment being by means of spacer bolts 33. The arrow guide is constituted by circular holder 34 which is held to the extension 30 by an appropriately shaped block 35. As can be seen, the shaft of the arrow is slidably supported by three prongs 36 which are longitudinally adjustable at the end of three circumferentially spaced holders 37.

The holders themselves are conventional and are constituted by a threaded bolt 38 which carry a low friction prong 36 at their free end. Two nuts, 39 and 40, permit the prongs 36 to be positioned, as desired, in order to define a space for the arrow shaft.

As will now be evident, when the string 11 is slightly pulled in FIG. 1, the arrow point will be removed from indentation 28 and bar 13 will retract to enable the arrow to be released.

What is claimed:

1. Apparatus for holding an arrow in a pulled bow and which releases an arrow when a bow is pulled slightly beyond the position in which an arrow is held, comprising a support adapted to be attached to a bow where the same is gripped by an archer, an arrow-holding bar having an arrow point-receiving indentation, said bar being movably mounted on said support to extend from an arrow-holding position in front of the point of an arrow in a pulled bow to a second position out of the path of an in place arrow, trigger means carried by said support immediately forward of a bow to move said bar into the path of an arrow so that the point of an arrow can be placed in said indentation to hold an arrow until it is pulled, and means biasing said bar out of the path of an arrow so that said bar will be removed from the path of an arrow when the point of an arrow is pulled out of said indentation.

2. Apparatus as recited in claim 1 in which said support extends rearwardly from a bow, and said arrow-holding bar extends at a right angle to said support in front of the point of an arrow in an arrow-holding position.

3. Apparatus as recited in claim 2 in which said arrow-holding bar is mounted for longitudinal sliding movement along its length, and spring means are provided to bias said bar away from its arrow-holding position.

4. Apparatus as recited in claim 3 in which said arrow-holding bar is mounted for sliding movement through a slot in said support.

5. Apparatus as recited in claim 3 in which said trigger is connected to a cable for moving said arrow-holding bar against the pressure of said spring means into arrow-holding position.

6. Apparatus as recited in claim 1 in which an arrow guide is mounted on the rear of said support to slidingly engage the shaft of an arrow between the pulled string and a bow.

7. Apparatus as recited in claim 6 in which said arrow-holding bar is positioned rearwardly of a bow whereby arrows too short to reach a bow when a bowstring is fully pulled may be projected from a bow.

8. Apparatus as recited in claim 6 in which said means to slidingly engage the shaft of an arow comprises a circular holder and three circumferentially spaced longitudinally adjustable prongs for defining an arrow shaft guideway.

9. Apparatus as recited in claim 1 in which said support carries a security plate positioned beneath said arrow-holding bar to extend beneath a held arrow, said security plate overlying the forearm of the archer when a bow is cocked.

* * * * *